US005540393A

United States Patent [19]

Stafford et al.

[11] Patent Number: 5,540,393

[45] Date of Patent: Jul. 30, 1996

[54] GYRASPHERE CRUSHER WITH BLADDER OPERATED BOWL LOCK MECHANISM

[75] Inventors: Robert G. Stafford, Mequon; Henry H. Polzin, Brookfield, both of Wis.

[73] Assignee: Astec Industries, Inc., Chattanooga, Tenn.

[21] Appl. No.: 430,428

[22] Filed: Apr. 28, 1995

[51] Int. Cl.[6] ..... B02C 2/00

[52] U.S. Cl. ..... 241/30; 241/286; 241/DIG. 30

[58] Field of Search ..... 241/37, 286, 290, 241/30, DIG. 30, 207–215

[56] References Cited

U.S. PATENT DOCUMENTS

| | | | |
|---|---|---|---|
| 325,761 | 9/1885 | Niles . | |
| 636,322 | 11/1899 | Danielson . | |
| 720,254 | 2/1903 | Keene . | |
| 1,131,659 | 3/1915 | Bommer . | |
| 1,282,588 | 10/1918 | Keene . | |
| 1,779,738 | 10/1930 | Johnson . | |
| 2,814,049 | 11/1957 | Mercur . | |
| 3,009,659 | 11/1961 | Jones | 241/DIG. 30 X |
| 3,272,446 | 4/1965 | Hesse . | |
| 3,323,732 | 6/1967 | Dalzell et al. | 241/290 X |
| 3,999,246 | 12/1976 | Suska . | |
| 4,539,727 | 9/1985 | Mautner et al. . | |
| 4,657,233 | 4/1987 | Vroom . | |
| 4,908,906 | 3/1990 | Hanna . | |
| B1 4,908,906 | 12/1993 | Hanna . | |

FOREIGN PATENT DOCUMENTS

| | | | |
|---|---|---|---|
| 44-4567 | 2/1969 | Japan | 241/286 |

*Primary Examiner*—Mark Rosenbaum
*Attorney, Agent, or Firm*—Nilles & Nilles, S.C.

[57] ABSTRACT

A gyrasphere crusher includes a crusher frame, a crushing head, and a crusher bowl which is selectively locked to and released from the crusher frame via operation of a bowl lock assembly including a clamping ring or locknut and an inflatable bladder device. The bladder device, which preferably is formed from a plurality of discrete bladder segments mounted on an axial end of the locknut, applies sufficient clamping forces to the locknut when it is fully inflated to prevent rotation of the locknut and bowl, and can be partially deflated to permit precisely controlled rotation of the bowl and thus adjustment of the crushing gap under load. The bladder operated bowl lock assembly is simple, reliable, and operates at a fraction of the pressures typically required for conventional mechanically applied/fluid-pressure released lock assemblies.

16 Claims, 5 Drawing Sheets

GYRASPHERE CRUSHER WITH BLADDER OPERATED BOWL LOCK MECHANISM

BACKGROUND OF THE INVENTION

1. Field of the Invention

The invention relates to gyrasphere crushers and, more particularly, relates to gyrasphere crushers having a crushing head, a crusher bowl which is vertically adjustable relative to the head, and a bowl lock assembly which normally prevents vertical adjustment of the bowl relative to the head but which selectively permits such adjustment.

2. Discussion of the Related Art

Gyrasphere crushers typically include a stationary frame, a generally conical crushing head mounted in the frame for rotation about an eccentric shaft and including an upwardly facing convex crushing surface, and an annular crusher bowl that is mounted on the frame above the head so as to define a crushing gap therebetween forming an annular crushing chamber. Material to be crushed is fed downwardly into the crushing chamber and is crushed by gyration of the head about the eccentric.

The particle size of the output from the crusher is dependent upon the thickness of the crushing gap. Particle size adjustment and/or compensation for wear on the opposed surfaces of the head and the bowl is thus possible by mounting the bowl on the crusher frame for vertical movement with respect thereto whereby the crushing gap is widened by raising the bowl or narrowed by lowering it. To permit such adjustment, the frame of the bowl is threadedly connected to an upper portion of the crusher frame, and the bowl is vertically adjusted by rotating it in the appropriate direction relative to the crusher frame.

When satisfactorily adjusted, the bowl must be locked or prevented from rotating relative to the crusher frame in response to the tangential forces imposed upon it by the gyrating head. This locking is typically performed via a threaded locknut or clamping ring which is located just above the threaded portion of the bowl frame and which is threadedly connected to the crusher frame so as to be selectively operable as a conventional locknut or jam nut. A substantial clamping force is normally exerted between the bowl and the locknut to urge them axially towards one another. For adjusting rotation of the bowl, this clamping force must of course be released.

Various arrangements or lock assemblies have been proposed for providing the necessary clamping force between the bowl and the locknut and for selectively releasing this clamping force. Early crushers employed a complex system of wedges for applying the clamping force, and these wedges had to be removed to permit adjustment. Such lock assemblies, an example of which is disclosed in U.S. Pat. No. 2,881,981 to Rumpel, proved complex and difficult to operate and soon were replaced with mechanically applied/fluid-pressure released lock assemblies which remain in wide use today.

Mechanically applied/fluid-pressure released lock assemblies typically employ a system of Belleville washers or other mechanical springs to apply clamping forces to the locknut. These forces are released by action of a plurality of single or double-acting hydraulic cylinders spaced around the locknut. Examples of mechanically applied/fluid-pressure released lock assemblies and their variants are disclosed, e.g., in U.S. Pat. Nos. 3,341,138 to Allen, 3,797,760 to Davis et al., 3,951,348 to Davis et al., 4,198,003 to Polzin et al., and 4,478,373 to Gieschen.

Mechanically applied/fluid-pressure released lock assemblies for gyrasphere crushers exhibit several drawbacks and disadvantages. Most notably, adjusting "on the fly," i.e., when the crusher is crushing rock (typically referred to as operating "under load") is difficult or impossible. Adjusting under load is desirable because crushers typically form but one component of a relatively large quarrying system with the crusher continuously receiving stone from upstream devices such as screens and supplying the crushed stone to downstream devices. Shutting down the crusher for adjustment therefore requires that the feed be shut down, thereby significantly increasing down time and operating costs. Adjusting under load is as a practical matter made difficult with crushers employing mechanically applied/fluid pressure released lock assemblies because there is a high amount of uncertainty as to the release point of such systems, (The release point is defined as that point at which the net clamping force applied by the mechanical springs as offset by the release forces supplied by the fluid actuated cylinders produces a rotational locking force which is just below the rotational forces supplied by bowl adjuster mechanisms). Uncertainty exists because spring forces vary from system to system and actually vary in a given crusher over the life of the springs because the spring rate decreases as the springs age. Given this uncertainty, it is typically necessary to fully or nearly fully release the clamping forces each time adjustment is required thereby preventing "feathering," i.e., relatively minute adjustments which do not significantly affect the current operation of the crusher. The need has therefore arisen to provide a lock assembly the net clamping forces imposed by which can be precisely controlled to permit adjustment of the bowl under load.

Another disadvantage associated with conventional mechanically applied/fluid-pressure released lock assemblies is that the cylinders apply the release forces over a very small area and thus must operate under extremely high pressures, typically on the order of 7000 psi or more. Operating under such high pressures requires the use of relatively expensive high pressure fittings and hoses and renders the system more prone to leaks. The need has therefore arisen to permit the release of lock assemblies for crushers using relatively low fluid pressures.

OBJECTS AND SUMMARY OF THE INVENTION

It is therefore an object of the invention to provide a gyrasphere crusher the bowl of which can be precisely adjusted under load, thereby decreasing down time and operating costs.

Another object of the invention is to provide a gyrasphere crusher the clamping ring or locknut of which can be operated using relatively low fluid pressures.

Yet another object of the invention is to provide a gyrasphere crusher which has one or more of the characteristics discussed above but which is relatively simple to manufacture and assemble.

In accordance with a first aspect of the invention, these objects are achieved by providing a crusher comprising a crusher frame, a crushing head rotatably mounted on the crusher frame, a crusher bowl mounted on an upper crusher frame above the head with a crushing gap formed therebetween, the bowl being adjustable with respect to the upper crusher frame and the head so as to adjust the thickness of the gap, and a lock assembly which normally locks the bowl in position but which selectively permits adjustment of the bowl on the upper crusher frame. The lock assembly includes a locknut which is connected to the bowl and which is threadedly mounted on the upper crusher frame, and an inflatable elastomeric bladder device which, when inflated, applies clamping forces to the locknut and prevents rotation of the locknut relative to the crasher frame and which, when at least partially deflated, at last partially releases the clamping forces and permits rotation of the locknut relative to the crusher frame. Because the bladder device applies all clamping forces, the lock assembly lacks mechanical spring devices applying biasing forces to the locknut.

Preferably, the locknut is annular and the bladder device is mounted on an axial end surface of the locknut and extends around essentially the entire circumference of the locknut. The locknut has a plurality of arcuate cavities formed in an axial surface thereof, and the bladder device is formed from a plurality of independently pressurizeable arcuate bladder segments each of which is mounted in a respective one of the cavities.

Yet another object of the invention is to provide a method of precisely adjusting the gap between the crushing head and crusher bowl of a gyrasphere crusher.

In accordance with another aspect of the invention, this object is achieved by providing a method comprising feeding rocks into a crushing gap formed between a rotatable crushing head of a crusher and a crusher bowl located above the head, the bowl being threadedly mounted on a crusher frame, and the thickness of the gap being adjustable by rotating the bowl on the crusher frame. The rocks are then crushed in the gap by eccentrically rotating the head. Maintaining the gap is normally accomplished by applying a clamping force to a locknut attached to the bowl and threadedly mounted in the crusher frame, the clamping force being applied by inflating an elastomeric bladder device coupled to the locknut. However, the thickness of the gap is periodically adjusted by: (1) at least partially deflating the bladder device, thereby relieving the clamping force sufficiently to permit rotation of the bowl with respect to the crusher frame; then (2) rotating the locknut and the bowl with respect to the crusher frame, thereby vertically moving the bowl and adjusting the gap thickness; and then (3) re-inflating the bladder device, thereby reapplying the clamping force and locking the bowl in position.

Because bladder release can be controlled to apply clamping forces which are just below the release point of the lock assembly, the adjusting step can take place without stopping the crushing step, thereby reducing downtime and operating costs.

In addition, because the bladder device operates over a relatively large area, relatively low pressures can be used to lock the bowl in place. Indeed, the preventing step comprises inflating the bladder device to no more than about 500 psi, and typically to no more than about 250 psi.

Other objects, features, and advantages of the present invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENT

1. Resume

Pursuant to the invention, a gyrasphere crusher is provided the bowl of which is selectively locked to and released from the crusher frame via operation of a bowl lock assembly including a locknut and an inflatable bladder device. The bladder device, which preferably is formed from a plurality of discrete bladder segments mounted on an axial end of the locknut, applies sufficient clamping forces to the locknut when it is fully inflated to prevent rotation of the locknut and bowl, and can be partially deflated to permit precisely controlled rotation of the bowl and thus adjustment of the crushing gap under load. The bladder operated bowl lock assembly is simple, reliable, and operates at a fraction of the pressures typically required for conventional mechanically applied/fluid-pressure released lock assemblies.

2. System Overview

Figure 1:
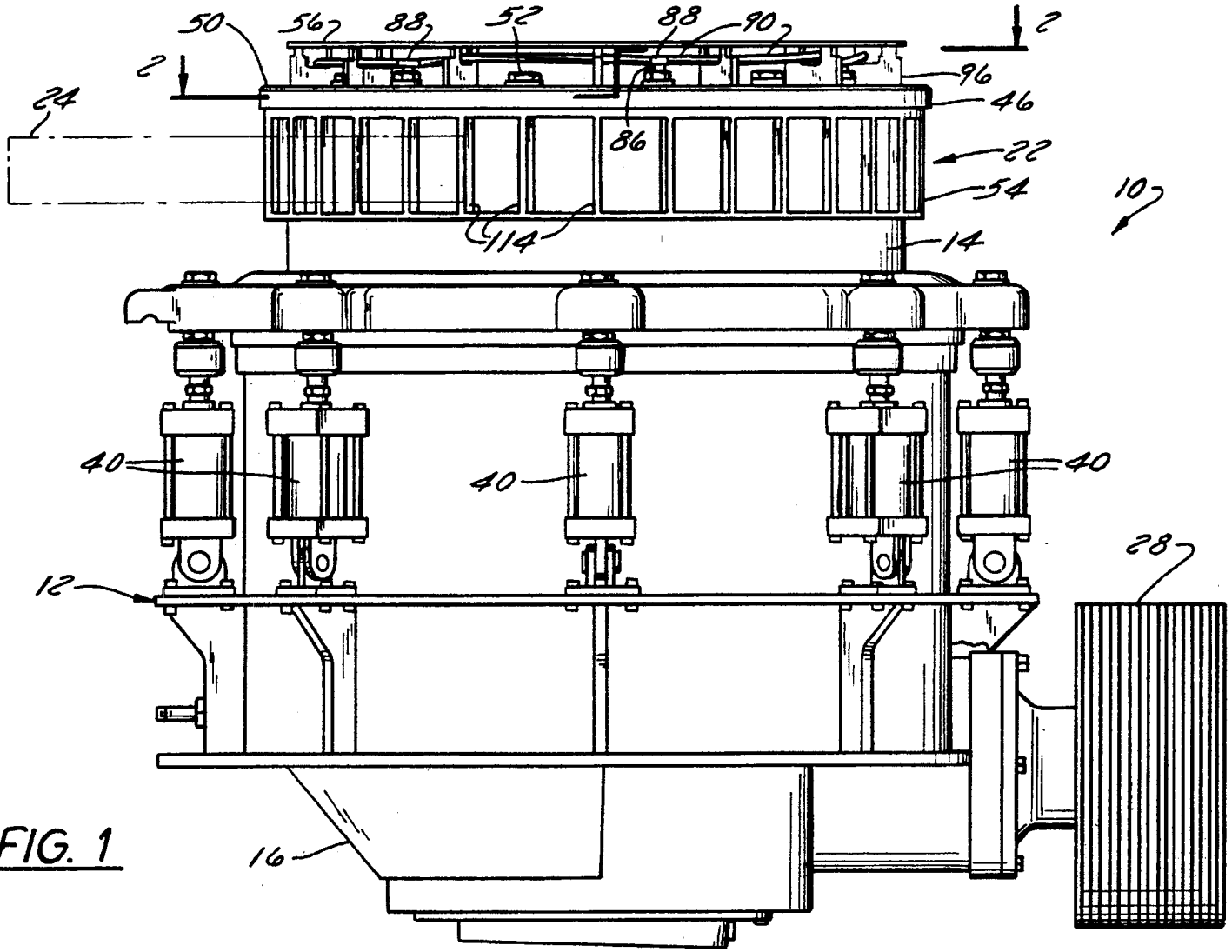
FIG. 1 is a side elevation view of a gyrasphere crusher employing a bowl lock assembly constructed in accordance with a preferred embodiment of the present invention.
Figure 2:
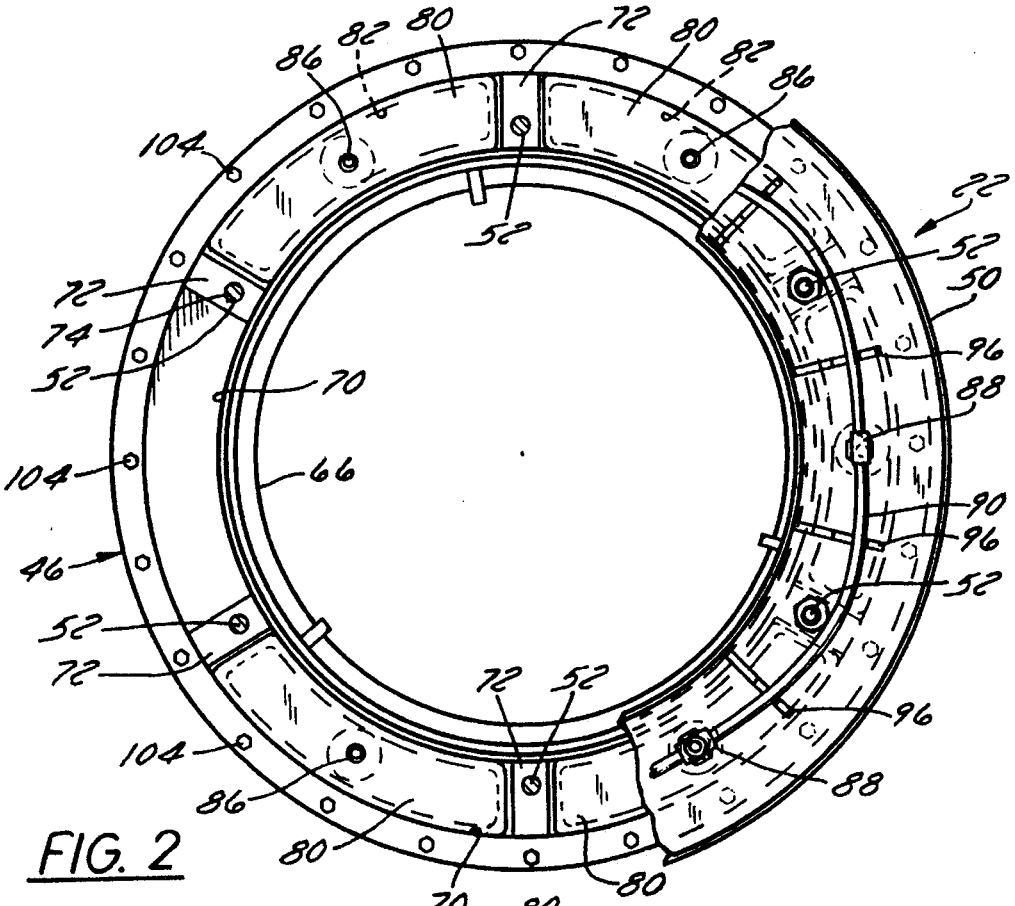
FIG. 2 is a partially cut-away sectional plan view taken generally along the lines 2—2 in FIG. 1.
Figure 2A:
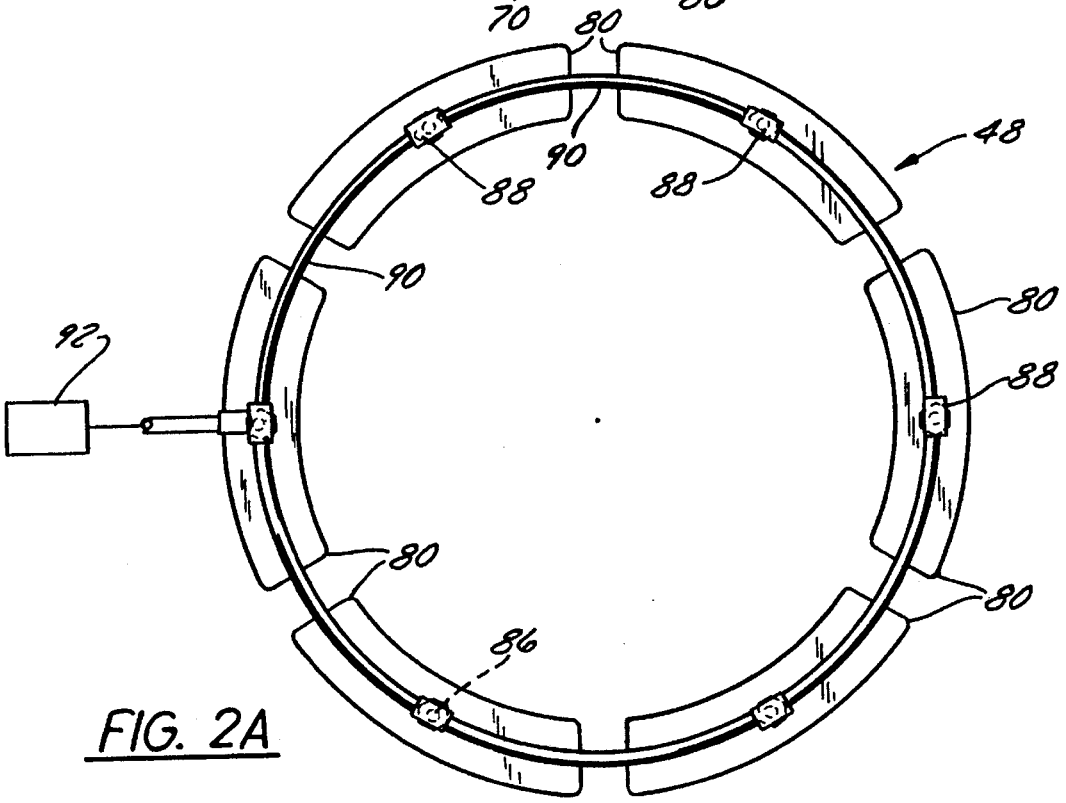
FIG. 2A is a sectional plan view generally corresponding to FIG. 2 but illustrating only the bladder device, hydraulic pressure source, and associated hoses and fittings.
Figure 3:
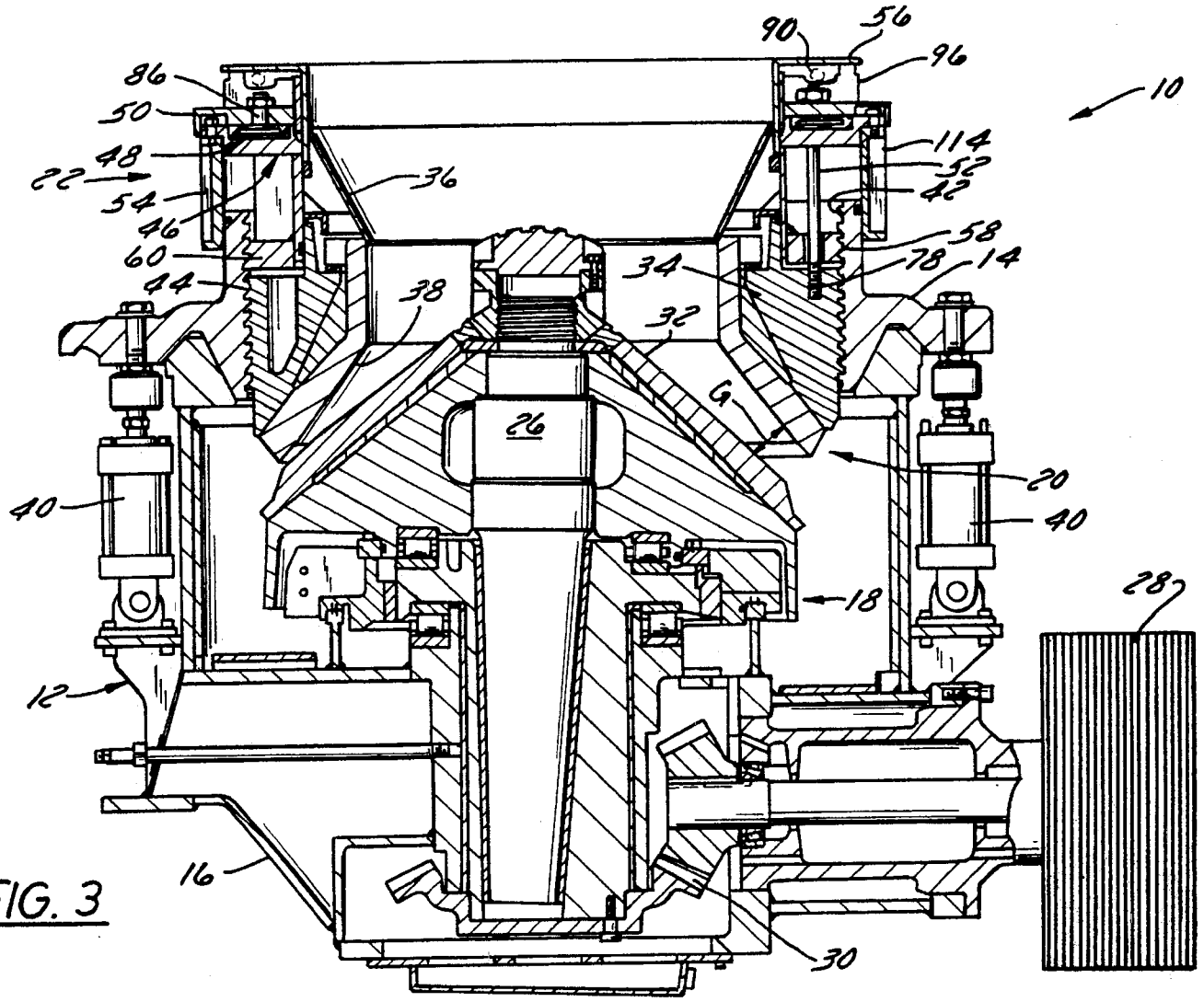
FIG. 3 is a sectional elevation view of the gyrasphere crusher illustrated in FIG. 1.

Referring now to the drawings and to FIGS. 1–3 in particular, a gyrasphere crusher 10 is illustrated and includes a main crusher frame 12 having upper and lower portions 14 and 16, a crushing head 18 mounted in the crushing frame lower portion 16, and a crusher bowl 20 mounted in the crusher frame upper portion 14 above the crushing head 18. The bowl 20 is normally held fast from rotation with respect to the crusher frame upper portion 14 by a bowl lock assembly 22, but the lock assembly 22 is selectively at least partially releasable to permit vertical adjustment of the bowl 20 relative to the head 18 by a bowl adjuster mechanism 24 as detailed below.

The crushing head 18 is mounted in the crusher frame lower portion 16 by an eccentric shaft 26 rotatably journaled in the crusher frame lower portion 16 and connected to a drive pulley 28 by a conventional torque transfer system 30. The head 18 also presents an upper generally frusto conical convex crushing surface 32 formed from a replaceable liner. The head 18 and its drive system 28, 30 are conventional and, accordingly, will not be described in further detail.

The crusher bowl 20 includes a body or frame 34, an upper uncrushed and/or precrushed rock feed hopper 36, and a hardened lower concave surface 38 which is formed from a replaceable liner. Concave surface 38 surrounds the convex crushing surface 32 of the crushing head 18 and is spaced above it to define a crushing gap G forming an annular crushing cavity. In order to permit vertical adjustment of the crusher bowl 20 relative to the crusher frame 12 and thus to permit adjustment of the thickness of gap G, a helically threaded connection is provided between the bowl 20 and the frame 12 in the form of an internal helical thread 42 on the crusher frame upper portion 14 and an external helical thread 44 on the frame 34 of bowl 20.

The crusher frame upper portion 14 is supported on the frame lower portion 16 by a plurality of tramp relief cylinders 40 which can be selectively actuated for tramp relief purposes in a manner which is, per se, well known and which forms no part of the present invention. The gyrasphere crusher 10 as thus far described, save for the lock assembly 22 and the mating features of the bowl 20 and crusher frame upper portion 14, is conventional.

3. Construction of Lock Assembly

The bowl 20 is normally locked from rotation with respect to the frame 12 by the lock assembly 22 which includes an annular locknut or clamping ring 46, a bladder device 48 mounted on an axial end surface of the locknut 46 and extending around essentially the entire circumference thereof, a clamp ring 50 mounted on the bladder device 48, and a plurality of studs 52. A locknut cover 54 is mounted on the outer radial periphery of the locknut 46, and an annular guard 56 is mounted on the upper surface of the clamp ring 50. Each of these devices will now be described in turn.

Figure 4:
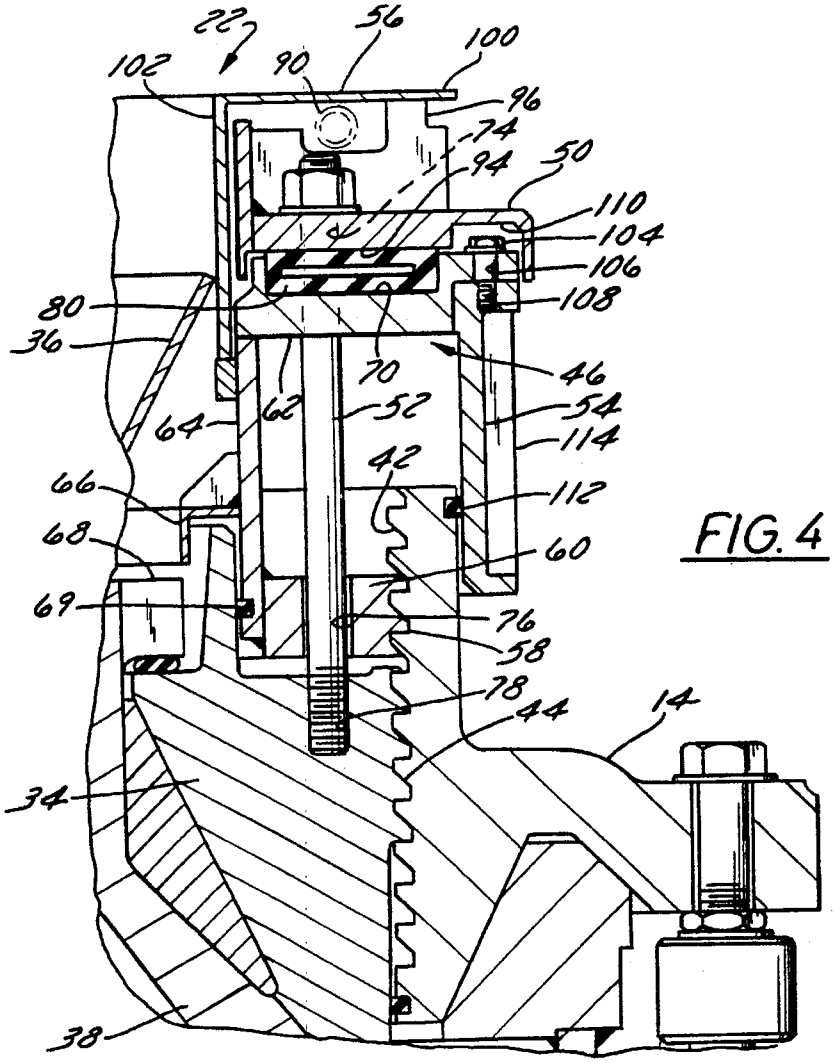
FIGS. 4 and 5 are enlarged fragmented views of portions of FIG. 3.
Figure 5:
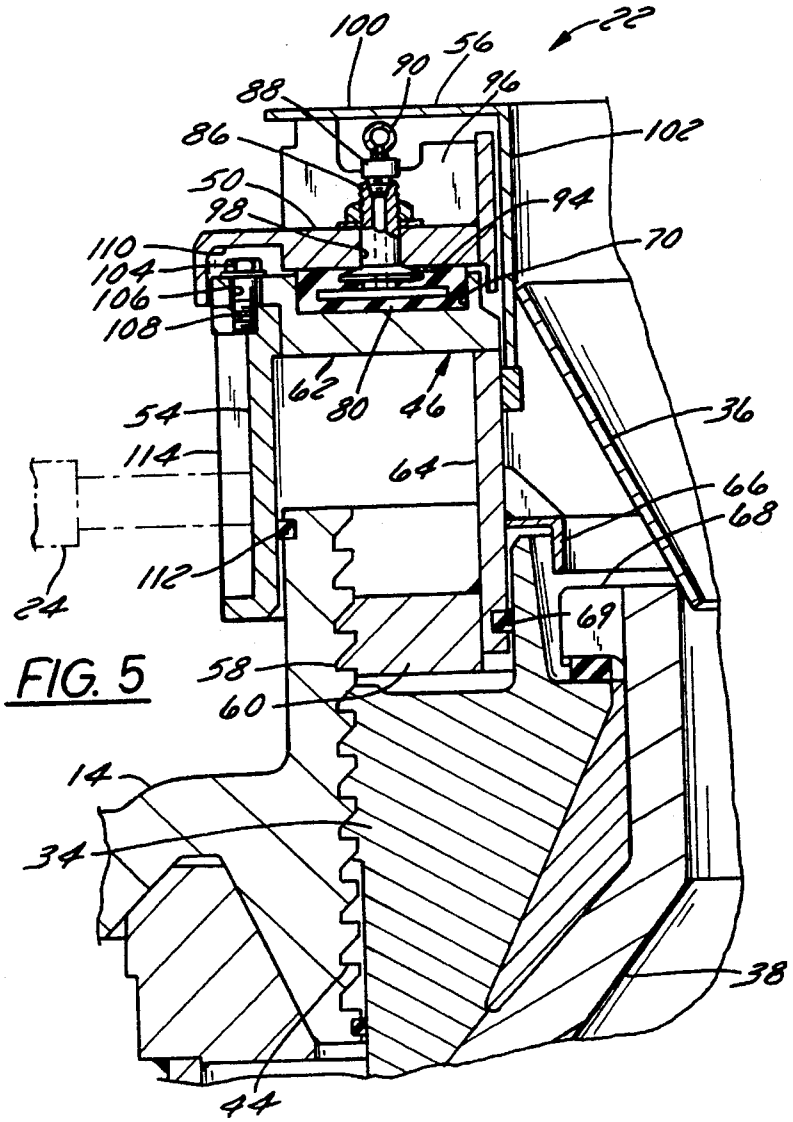
Figure 6:
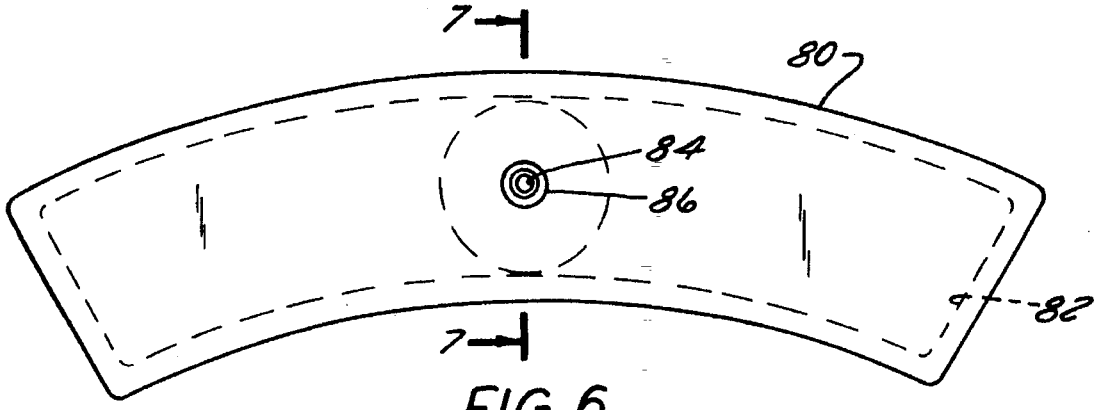
FIG. 6 is a top plan view of one of the bladder segments illustrated in FIG. 2A.
Figure 7:
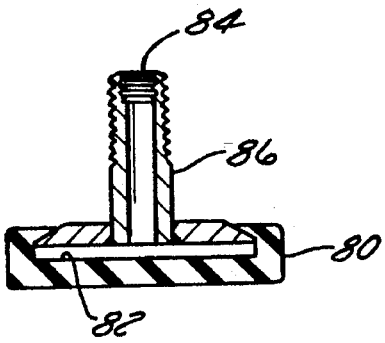
FIG. 7 is a sectional elevation view taken along the lines 7—7 in FIG. 6.

The locknut 46 is designed to lock the bowl 20 from rotation when it receives sufficient clamping forces from the bladder device 48 and to permit rotation of the bowl 20 in the absence of such clamping forces. To this end, the locknut 46 is fixed to the bowl frame 34 by the studs 52 as detailed below and has threads 58 formed on its outer radial periphery so as to be rotatable in the threads 42 of the crusher frame upper portion 14. Locknut 46 is generally C-shaped and includes a lower portion 60 having the threads 58 mounted thereon, an upper clamping portion 62, and a vertical portion 64 located near the inner radial edge of the locknut 46 and connecting the clamping portion 62 to the threaded portion 60. A generally annular flange 66 extends radially inwardly frown the inner edge of the vertical portion 64 for receiving an upwardly projecting annular flange 68 (see FIG. 4.) of the bowl 20. A sealing ring 69 is provided between the inner surface of the locknut 46 and the annular flange 68. The clamping portion 62 has a plurality (6 in the illustrated embodiment) of arcuate cavities 70 formed in the upper axial end surface thereof for receiving the bladder segments 80 (described in more detail below). Each of the cavities 70 has a depth which is generally equal to the fully deflated thickness of the bladder segments 80 such that, when the bladder segments 80 are inflated, they extend above the uppermost surface of the locknut 46 to engage the clamp ring 50 and apply clamping forces to the locknut 46. Adjacent cavities 70 are separated by radial dividers 72, each of which has a hole 74 bored therethrough for the passage of a stud 52. Mating holes 76 are formed in the lower threaded portion 60, and these holes are aligned with tapped bores 78 in the bowl frame 34.

The bladder device 48 is formed from a plurality (6 in the illustrated embodiment) of rubber or other elastomeric segments 80 which are mounted in the cavities 70 in the upper axial end surface of the upper clamping portion 62 of locknut 46. The bladder device 48 is segmented in this manner to avoid interference with the studs 52 where they pass through the clamp ring 50 and locknut 46 and to help each segment 80 hold its shape. Each bladder segment 80 has a hollow interior 82 and a central upper aperture 84 which sealingly receives a valve stem 86. Valve stem 86 has an outlet opening into the bladder segment interior 82 and an inlet connected to a T-fitting 88 which is in turn connected to a generally circular hose assembly 90. The hose assembly 90 is connected to a conventional hydraulic pressure source 92 which can be operated to permit the simultaneous pressurization or depressurization of all of the bladder segments 80.

The primary purposes of the clamp ring 50 are to clamp the bladder segments 80 in the cavities 70 and to provide a reaction member via which clamping forces created upon inflation of the bladder device 48 are imparted to the locknut 46. To this end, the clamp ring 50 has a lower surface 94 which is planar in the vicinity of the cavities 70 so as to provide a uniform engagement surface for the bladder device 48. Clamp ring 50 also presents a plurality of generally U-shaped radial ribs 96 which extend upwardly from the upper axial surface thereof so as to support the upper guard 56 while providing a passage for the hose assembly 90 between the legs of the "U." In addition, a plurality of apertures 98 are formed through the clamp ring 50, between the apertures 74 for the studs 52, for receiving the valve stems 86.

The upper guard 56 protects the hose assembly 90 and forms part of the hopper 36. To this end, upper guard 56 is formed from a unitary metal member and includes (1) an annular plate 100 which overlies the clamp ring 50 and rests on ribs 96 and (2) an inner cylinder 102 forming the upper or cylindrical portion of the hopper 36.

Each of the studs 52 extends through one of the holes 74 in the clamp ring 50 and a mating hole 76 in the locknut 46 and threadedly engages a tapped bore 78 in the bowl frame 34, thereby nonrotatably connecting the locknut 46 to the bowl 20. The studs 52 also connects the clamp ring 50 to the locknut 46 to hold the bladder device 48 therebetween, thereby assuring that inflation of the bladder device 48 will result in the application of clamping forces to the locknut 46.

The primary purpose of the locknut cover 54 is to provide a mechanism via which tangential or rotational forces applied by the bowl adjuster mechanism 24 are translated into rotational forces tending to rotate the locknut 46 and the bowl 20 on the crusher frame 12. To this end, locknut cover 54 is connected to the locknut 46 by a plurality of bolts 104 extending (1) through axial bores 106 formed in the outer radial portion of the locknut 46 and (2) into axial taps 108 formed in the upper portions of the locknut cover 54. An annular recess 110 is formed in the lower axial surface of the clamp ring 50 to provide clearance for the heads of bolts 104. A sealing ring 112 is disposed between the inner radial surface of the locknut cover 54 and the outer radial surface of the upper frame 14, and a plurality of axial lugs or ribs 114 are formed on the outer axial surface of the locknut cover 54 and extend radially outwardly for cooperation with the adjuster mechanism 24.

The bowl adjuster mechanism 24 may comprise any device capable of imparting rotational forces of designated magnitudes through designated strokes to the locknut cover 54 and preferably comprises a hydraulically actuated mechanism applying tangential forces to the lugs or ribs 114. A suitable adjuster mechanism is disclosed in U.S. Pat. No. 3,396,915 to Allen, the subject matter of which is hereby incorporated by reference.

4. Operation of Crusher

During normal operation of the crusher 10, rocks or stones are fed to the hopper 36 from a screen or the like and fall into the crushing cavity, where they are crushed between the concave surface 38 of the crusher bowl 20 and the convex surface 32 of the crushing head 18 upon eccentric rotation of the head 18 about shaft 26. The particle sizes of the: crushed rock thus produced are defined by the thickness of the gap G formed between the head 18 and the bowl 20.

The crusher bowl 20 is locked in place at this time by inflating the bladder segments 80 through the supply of pressurized hydraulic fluid to the segment interiors 82 from the hydraulic pressure source 92 and the hose assembly 90. It should be noted that because the area over which the hydraulic pressure is applied to the locknut 46 from bladder segments 80 is dramatically larger than that over which conventional hydraulic cylinders act, dramatically lower pressures can be employed. Most conventional fluid pressure-applied or released lock assemblies require hydraulic pressures in the range of 5000 to 10,000 psi to lock or release locknuts. The lock assembly 22 employing the inflatable bladder device 48, on the other hand, applies the same clamping forces using hydraulic pressures of no more than 500 psi and typically no more than about 200–250 psi. A lower-power and less expensive pressure source 92 can therefore be employed along with less expensive and more reliable low pressure hoses and fittings.

Assuming now that it is desired to adjust vertically the crusher bowl 20 relative to the upper crushing frame 14 and crushing head 18, the bladder segments 80 are partially deflated to relieve a portion of the clamping forces applied to the locknut 46, and the adjuster mechanism 24 is actuated to drive the lugs 114 on the locknut cover 54 tangentially, thereby rotating the locknut cover 54 and hence rotating the locknut 46. Rotational motion of locknut 46 is transferred to the bowl 20 through the studs 52 so that the locknut 46 and bowl 20 rotate about the threads 42, 44, 58 to vertically adjust the bowl 20, thereby adjusting the thickness of the crushing gap G. Unlike in mechanically applied/fluid-pressure released lock assemblies, the net clamping force applied by the bladder device 48 can be controlled via suitable operation of the hydraulic pressure source 92 to be just below the release point of the lock assembly 22 (defined as that point at which the net clamping forces applied by the bladder device 48 are just below the rotational forces imparted by the adjuster mechanism 24). Assuredly, operating the adjuster mechanism 24 with significant but not excessive resistance from the lock assembly 22 permits adjustment at a relatively slow, controlled rate, thereby permitting adjustment under load. This obviates the need to shut down the quarry plant to adjust the bowl 20, thereby significantly reducing downtime and operating costs.

Of course, many changes and modifications could be made to the invention as disclosed without departing from the spirit thereof, and the scope of such changes will become apparent from the appended claims.

We claim:

1. A crusher for crushing stones, said crusher comprising:

(A) a crusher frame:

(B) a crushing head rotatably mounted on said crusher frame;

(C) a crusher bowl mounted on said crusher frame above said head with a crushing gap formed therebetween, said bowl being adjustable with respect to said crusher frame and said head upon the imposition of a designated rotational force on said bowl so as to adjust the thickness of said gap;

(D) a lock assembly which normally locks said bowl in position but which selectively permits adjustment of said bowl on said crusher frame, said lock assembly including (1) a locknut which is connected to said bowl and which is threadedly mounted on said crusher frame, and (2) an inflatable elastomeric bladder device which, when inflated, applies clamping forces to said locknut and prevents rotation of said locknut relative to said crusher frame and which, when deflated, at last partially releases said clamping forces and permits rotation of said locknut relative to said crusher frame; and (E) means for (a) selectively inflating said bladder device and for (b) selectively partially deflating said bladder device to just below a pressure at which the clamping forces applied by said bladder device can be overcome by the designated rotational force on said bowl, thereby permitting bowl adjustment while said crusher is crushing stone.

2. A crusher as defined in claim 1, wherein said lock assembly lacks mechanical spring devices applying biasing forces to said locknut.

3. A crusher as defined in claim 1, further comprising a bowl adjuster mechanism, and wherein said locknut is annular and comprises a lower threaded portion, an upper clamping portion on which is mounted said bladder device, and a vertical portion connecting said clamping portion to said threaded portion, said lock assembly further including (A) a clamp ring disposed above said bladder device;

(B) a plurality of threaded studs which extend through said clamp ring and said threaded portion and clamping portion of said locknut and which extend into tapped bores in said bowl, thereby connecting said locknut to said bowl; and (C) a cylindrical locknut cover which is mounted on an outer radial periphery of said locknut and which is selectively rotated by said bowl adjuster mechanism to rotate said locknut and said bowl relative to said crusher frame.

4. A crusher as defined in claim 3, further comprising a hose assembly communicating with said bladder device, wherein said clamp ring presents a plurality of ribs which extend axially upwardly from an upper axial surface thereof, each of said ribs being generally U-shaped and presenting a pair of legs defining a passage therebetween, said hose assembly being supported by said ribs and being disposed in said passages in said ribs.

5. A crusher as defined in claim 4, further comprising an annular guard mounted on the upper axial surface of said clamp ring and overlying said hose assembly.

6. A crusher as defined in claim 5, further comprising a feed hopper which is supported on said crusher frame and which feeds stones to be crushed into said crusher bowl, and wherein said guard comprises (1) an annular plate which overlies said clamp ring and which rests on said ribs and (2) an inner cylinder which forms a portion of said feed hopper.

7. A crusher comprising:

(A) a crusher frame:

(B) a crushing head rotatably mounted on said crusher frame;

(C) a crusher bowl mounted on said crusher frame above said head with a crushing gap formed therebetween, said bowl being adjustable with respect to said crusher frame and said head so as to adjust the thickness of said gap; and (D) a lock assembly which normally locks said bowl in position but which selectively permits adjustment of said bowl on said crusher frame, said lock assembly including (1) a locknut which is connected to said bowl and which is threadedly mounted on said crusher frame, and (2) an inflatable elastomeric bladder device which, when inflated, applies clamping forces to said locknut and prevents rotation of said locknut relative to said crusher frame and which, when at least partially deflated, at last partially releases said clamping forces and permits rotation of said locknut relative to said crusher frame, wherein said locknut is annular, wherein said bladder device is mounted on an upper axial end surface of said locknut and extends around essentially the entire circumference of said locknut, and wherein when pressurized, said bladder device biases said locknut downwardly.

8. A crusher as defined in claim 7, wherein said locknut has a plurality of arcuate cavities formed in an axial surface thereof, and wherein said bladder device is formed from a plurality of independently pressurizeable arcuate bladder segments each of which is mounted in a respective one of said cavities.

9. A crusher as defined in claim 8, further comprising a hydraulic pressure source and a plurality of valve stems, each of which has an inlet connected to said hydraulic pressure source and an outlet opening into one of said bladder segments.

10. A crusher as defined in claim 7, wherein said lock assembly further comprises (1) a locknut clamp ring mounted in axial alignment with said bladder device and (2) a plurality of studs which extend through said clamp ring and said locknut and which are threadedly received in said bowl beneath said locknut.

11. A crusher comprising:

(A) a crusher frame:

(B) a crushing head rotatably mounted on said crusher frame and presenting an upper concave surface;

(C) a crusher bowl which includes a bowl frame threadedly mounted on said crusher frame above said head and which presents a lower convex surface facing said concave surface of said head with a crushing gap formed therebetween, said bowl being vertically adjustable with respect to said crusher frame and said head so as to adjust the thickness of said gap;

(D) a hydraulic pressure source;

(E) a bowl adjuster mechanism; and (F) a lock assembly which normally locks said bowl in position but which selectively permits adjustment of said bowl relative to said crusher frame and said head, said lock assembly including (1) an annular locknut which includes a lower threaded portion which engages a mating threaded portion on said crusher frame, an upper clamping portion, and a vertical portion connecting said clamping portion to said threaded portion, said clamping portion having a plurality of arcuate cavities formed in an upper axial end surface thereof which collectively extend around essentially the entire circumference of said locknut and which are separated by one another by dividers, (2) an inflatable elastomeric bladder device including a plurality of arcuate bladder segments each of which is mounted in a respective one of said cavities and which is connected to said hydraulic pressure source, said bladder device (a) being pressurized by said hydraulic pressure source to force said locknut upwardly, thereby locking said locknut and said bowl from rotation, and (b) being selectively partially deflatable, (3) an annular clamp ring disposed above said bladder device, said clamp ring presenting a plurality of ribs which extend upwardly from an upper axial surface thereof, each of said ribs being generally U-shaped and presenting a pair of legs defining a passage therebetween.

(4) a plurality of threaded studs which extend through said clamp ring and said threaded portion and said dividers of said clamping portion of said locknut and which extend into a tapped bore in said bowl frame, thereby attaching said locknut to said bowl, (5) a cylindrical locknut cover which is mounted on an outer radial periphery of said locknut and which is selectively rotatable by said bowl adjuster mechanism (a) while said crusher is performing a crushing operation, and (b) when said bladder device is partially deflated to just below a pressure at which forces applied by said bladder device can be overcome by a designated rotational force applied to said locknut cover, thereby rotating said locknut relative to said crusher frame and vertically adjusting said locknut relative to said crusher frame and said head and adjusting the thickness of said gap, (6) a guard which is disposed above said clamp ring, said guard comprising (1) an annular plate which overlies said clamp ring and rests on said ribs and (2) an inner cylinder, and (7) a hose assembly communicating with said pressure source and said bladder segments, said hose assembly being supported by said ribs and being disposed in said passages in said ribs.

12. A method comprising:

(A) feeding rocks into a crushing gap formed between a rotatable crushing head of a crusher and a crusher bowl located above said head, said bowl being threadedly mounted on a crusher frame, the thickness of said gap being adjustable by rotating said bowl on said crusher frame;

(B) eccentrically rotating said head to crush rocks in said gap;

(C) normally preventing adjustment of said gap by applying a clamping force to a locknut attached to said bowl and threadedly mounted in said crusher frame, said clamping force being applied by inflating an elastomeric bladder device coupled to said locknut; and (D) periodically adjusting the thickness of said gap, said adjusting step including (1) partially deflating said bladder device, thereby relieving said clamping force sufficiently to permit rotation of said bowl with respect to said crusher frame, then (2) rotating said locknut and said bowl with respect to said crusher frame, thereby vertically moving said bowl and adjusting said gap thickness, and then (3) re-inflating said bladder device, thereby reapplying said clamping force and locking said bowl in position, wherein said adjusting step takes place without stopping said crushing step.

13. A method as defined in claim 12, wherein said preventing step comprises inflating said bladder device to no more than about 500 psi.

14. A method as defined in claim 13, wherein said preventing step comprises inflating said bladder device to no more than about 250 psi.

15. A method as defined in claim 12, wherein said bladder device comprises a plurality of bladder segments mounted in respective arcuate cavities formed in an axial surface of said locknut, and wherein said inflating step comprises supplying hydraulic fluid to all of said bladder segments from a common hydraulic pressure source.

16. A method comprising:

(A) feeding rocks into a crushing gap formed between a rotatable crushing head of a crusher and a crusher bowl located above said head, said bowl being threadedly mounted on a crusher frame, the thickness of said gap being adjustable by rotating said bowl on said crusher frame;

(B) eccentrically rotating said head to crush rocks in said gap;

(C) normally preventing adjustment of said gap by applying a clamping force to a locknut attached to said bowl and threadedly mounted in said crusher frame, said clamping force being applied by inflating an elastomeric bladder device coupled to said locknut; and (D) periodically adjusting the thickness of said gap, said adjusting step including (1) partially deflating said bladder device, thereby relieving said clamping force sufficiently to permit rotation of said bowl with respect to said crusher frame, then (2) rotating said locknut and said bowl with respect to said crusher frame, thereby vertically moving said bowl and adjusting said gap thickness, and then (3) re-inflating said bladder device, thereby reapplying said clamping force and locking said bowl in position, wherein said adjusting step takes place without stopping said crushing step wherein said adjusting step takes place without stopping said crushing step, and wherein said step of rotating said bowl comprises applying a designated rotational force to said locknut and wherein said deflating step comprises deflating said bladder device to just below a pressure at which the clamping forces applied by said bladder device can be overcome by said designated rotational force.

* * * * *